US005715502A

United States Patent [19]

Taniguchi et al.

[11] Patent Number: 5,715,502

[45] Date of Patent: Feb. 3, 1998

[54] TONER CONVEYER

[75] Inventors: Susumu Taniguchi; Hiroki Morishita; Shinichi Kotera, all of Osaka, Japan

[73] Assignee: Mita Industrial Co., Ltd., Osaka, Japan

[21] Appl. No.: 683,202

[22] Filed: Jul. 18, 1996

[30] Foreign Application Priority Data

Jul. 26, 1995 [JP] Japan ..... 7-190641

[51] Int. Cl.[6] ..... G03G 15/08

[52] U.S. Cl. ..... 399/256; 399/358; 366/318

[58] Field of Search ..... 399/102, 103, 399/256, 263, 358, 359; 384/369, 398, 420; 366/244, 245, 247, 318, 343

[56] References Cited

U.S. PATENT DOCUMENTS

| | | | |
|---|---|---|---|
| 3,981,547 | 9/1976 | Perruzzi . | |
| 4,397,571 | 8/1983 | Morrill . | |
| 5,113,227 | 5/1992 | Miyasaka . | |
| 5,166,731 | 11/1992 | Aimoto et al. . | |
| 5,170,212 | 12/1992 | DeCecca | 355/245 |
| 5,294,968 | 3/1994 | Ueda et al. . | |
| 5,355,199 | 10/1994 | Bray . | |
| 5,442,423 | 8/1995 | Edmunds et al. . | |

FOREIGN PATENT DOCUMENTS 0430098 6/1991 European Pat. Off. .

OTHER PUBLICATIONS

Patent Abstracts of Japan, vol. 016, No. 373 (P. 1400), Aug. 11, 1992, and Japan 04 118674 (Canon, Inc., Apr. 20, 1992 (abstract).

Patent Abstracts of Japan, vol. 016, No. 345 (p. 1392), Jul. 27, 1992 and Japan 04104277, Apr. 6, 1992 (abstract).

Patent abstract of Japan vol. 16., No. 109 (p. 1326), Mar. 17, 1992 and Japan 03 282489, Dec. 12, 1991 (abstract).

*Primary Examiner*—Robert Beatty

*Attorney, Agent, or Firm*—Beveridge, DeGrandi, Weilacher & Young LLP

[57] ABSTRACT

A toner conveyer applied to a housing having a pair of side walls and a through hole formed in at least one of the pair of side walls. The toner conveyer includes a shaft which is inserted at its one end portion in said through hole formed in one of said pair of side walls and is mounted between said pair of side walls to rotate. A main spiral vane is formed on the outer peripheral surface of a main portion of the shaft. An inside limiting piece is formed at the one end portion of the shaft. The inside limiting piece has protruded portions that extend in the radial direction beyond the inner diameter of the through hole and non-protruded portions located on the inside of the inner diameter of the through hole in the radial direction. The shaft is limited from moving toward one of the pair of side walls as the protruded portions come into contact with the inner surface of one of the pair of side walls but the communication is maintained between the through hole and the interior of the housing owing to the presence of the non-protruded portions. An auxiliary spiral vane is formed on the one end portion of the shaft at a position on the outer side of the inside limiting piece and is located in the through hole to send back the toner that has entered into the through hole to the housing when the shaft is rotated in a predetermined direction.

8 Claims, 4 Drawing Sheets

TONER CONVEYER

FIELD OF THE INVENTION

The present invention relates to a toner conveyer used for conveying toner in a cleaning means and/or in a developing means arranged in an image-forming machine such as copying machine, printer or facsimile of the type in which an electrostatic latent image is developed into a toner image which is then transferred onto a transfer member.

DESCRIPTION OF THE PRIOR ART

An image-forming machine such as copying machine, printer or facsimile has been widely put into practical use, in which an electrostatic latent image is formed on an image-carrying means and is developed into a toner image which is then transferred onto a transfer member such as common paper. The image-carrying means is usually constituted by a rotary drum having an electrostatic photosensitive material arranged on the surface thereof. The image-forming machine includes a developing means for developing the electrostatic. latent image on the image-carrying means into a toner image and a cleaning means for removing the toner remaining on the image-carrying means after the transfer operation. The developing means includes a toner conveying means for conveying the toner discharged from a toner cartridge into a developing housing or for conveying the toner through a predetermined passage in the developing housing. The cleaning means includes the toner conveying means for discharging the toner from, for example, a cleaning housing.

As is widely known among people skilled in the art, typical examples of a toner conveying means arranged in the developing means and/or in the cleaning means is constituted by a toner conveyer which is called a rotary spiral vane. Such a toner conveyer is constituted by a shaft and a spiral vane formed on the peripheral surface thereof. When the toner conveyer is used, for example, for discharging the toner from the cleaning housing after it has been removed from the surface of the image-carrying means and has been caused to flow into the cleaning housing, a through hole is usually formed in each of a pair of side walls of the cleaning housing. One end of the shaft of the toner conveyer is inserted in a through hole formed in one side wall and the other end thereof is inserted in a through hole formed in the other side wall, so that the toner conveyer is rotatably mounted between the pair of side walls. One end of the shaft extends out of the housing through the hole, and an input member which may be an input gear is mounted on the extended end portion. The rotational driving force of an electric motor is transmitted to the input member, and the toner conveyer is rotated in a predetermined direction. As the toner conveyer rotates in a predetermined direction, the spiral vane formed on the peripheral surface of the shaft conveys the toner in the cleaning housing toward the other one of the pair of side walls and discharges it from the cleaning housing through the hole formed in the other one of the pair of side walls. The toner discharged from the cleaning housing is fed into a toner-recovering container through a toner conveying pipe member.

When the toner conveyer is, as described above, mounted in the housing by inserting one end of the shaft of the toner conveyer in the through hole formed in one of the pair of side walls of the housing, however, it becomes important to limit the toner conveyer from moving in the lengthwise direction of the shaft thereof and, particularly, to limit its motion toward one of the pair of side walls, as well as to sufficiently prevent the toner from leaking out of the housing through the hole formed in one of the pair of the side walls. So far, therefore, it has been attempted to form a circular piece at an end portion of the shaft, the circular piece having an outer diameter larger than the inner diameter of the through hole, to bring such a circular piece into contact with one inner surface of one of the pair of side walls to thereby limit the shaft from moving toward one of the pair of side walls, and thereby preventing the toner in the housing from entering into the through hole. The motion of the shaft toward the other one of the pair of side walls is, usually, limited as the input member mounted on the extended end portion of the shaft extending out of the housing comes into contact with the outer surface of one of the pair of side walls.

With the conventional toner conveyer, however, the present inventors empirically know that it is not possible to very reliably prevent the toner from entering into the through hole through the inner surface of the circular piece formed at one end portion of the shaft and the side wall (one of the pair of side walls) with which the circular piece is in contact, due to tolerance in producing the side walls of the housing and/or the toner conveyer. It is therefore difficult to sufficiently prevent the toner from leaking out of the housing; i.e., the toner tends to be deposited in the through hole to impair the toner conveyer from smoothly rotating.

SUMMARY OF THE INVENTION

The principal object of the present invention therefore is to improve the toner conveyer that is applicable to a housing which has a through hole formed in at least one of the pair of side walls, with a view to reliably limiting the shaft of the toner conveyer from moving toward one of the pair of side walls, to sufficiently preventing the toner from leaking out of the housing, and to reliably preventing the toner from depositing in the through holes.

Another object of the present invention is to provide an improved toner conveyer which enables an input member to be easily and quickly mounted on an extended end portion of the shaft of the toner conveyer that is extending out of the housing through a hole formed in one of the pair of side walls.

In order to accomplish the above-mentioned principal object according to the present invention, an inside limiting piece and an auxiliary spiral vane are formed at one end portion of the shaft of the toner conveyer. The inside limiting piece has protruded portions which extend in the radial direction exceeding the inner diameter of the through hole formed in one of the pair of side walls of the housing and non-protruded portions located on the inside of the inner diameter of the through hole in the radial direction. The shaft is prevented from moving toward one of the pair of side walls as the protruded portions come into contact with the inner surface of one of the pair of side walls, but communication between the through hole and the interior of the housing is maintained owing to the presence of the non-protruded portions. An auxiliary spiral vane is formed at a position on the outer side of the inside limiting piece, and is positioned in the through hole, and sends the toner that has entered into the through hole back to the housing when the shaft is rotated in a predetermined direction.

That is, in order to accomplish the above-mentioned object according to the present invention, there is provided a toner conveyer applied to a housing having a pair of side walls and a through hole formed in at least one of the pair of side walls, comprising:

a shaft which is inserted at its one end portion in said through hole formed in one of said pair of side walls and is mounted between said pair of side walls to rotate;

a main spiral vane formed on the outer peripheral surface of a main portion of said shaft;

an inside limiting piece formed at said one end portion of said shaft and having protruded portions that extend in the radial direction beyond the inner diameter of said through hole and non-protruded portions located on the inside of the inner diameter of said through hole in the radial direction, wherein said shaft is limited from moving toward one of said pair of side walls as said protruded portions come into contact with the inner surface of one of said pair of side walls but the communication is maintained between said through hole and the interior of said housing owing to the presence of said non-protruded portions; and an auxiliary spiral vane formed on said one end portion of said shaft at a position on the outer side of said inside limiting piece and is located in said through hole to send the toner that has entered into said through hole back to the housing when said shaft is rotated in a predetermined direction.

preferably, the toner conveyer includes a sealing piece which is formed on said one end portion of said shaft at a position on the outer side of said auxiliary spiral vane, and is positioned in said through hole, said sealing piece having an outer diameter which is substantially the same as, or is slightly smaller than, the inner diameter of said through hole. It is desired that said shaft, said main spiral vane, said inside limiting piece, said auxiliary spiral vane and said sealing piece are formed of a synthetic resin as a unitary structure. It is desired that said one end portion of said shaft extends out of said housing penetrating through said through hole, an input member is mounted on said extended end portion, and said input member comes into contact with the outer surface of one of said pair of side walls to limit said shaft from moving toward the other one of said pair of side walls.

In the toner conveyer for accomplishing the above-mentioned another object, said extended end portion of said shaft is split into two arms due to a slit that extends in the axial direction from the end surface, expanded head portions are formed at the ends of said two arms, said input member has a mounting opening having a lateral cross-sectional shape corresponding to a lateral cross-sectional shape that is defined by the portions of said two arms other than said expanded head portions, and said input member is mounted on said extended end portion of said shaft by allowing said expanded head portions to pass and fit to said two arms by elastically deforming the two arms in a direction in which said expanded head portions are brought close to each other.

In a preferred embodiment, a through hole constituting a toner discharge port is formed in the other one of said pair of side walls, and the other end portion of said shaft is inserted in the through hole formed in the other one of said pair of side walls. The main spiral vane conveys the toner in said housing toward said toner discharge port.

DETAILED DESCRIPTION OF THE PREFERRED EMBODIMENTS

The toner conveyer constituted according to the present invention will now be described in detail with reference to preferred embodiments in conjunction with the accompanying drawings.

Figure 1:
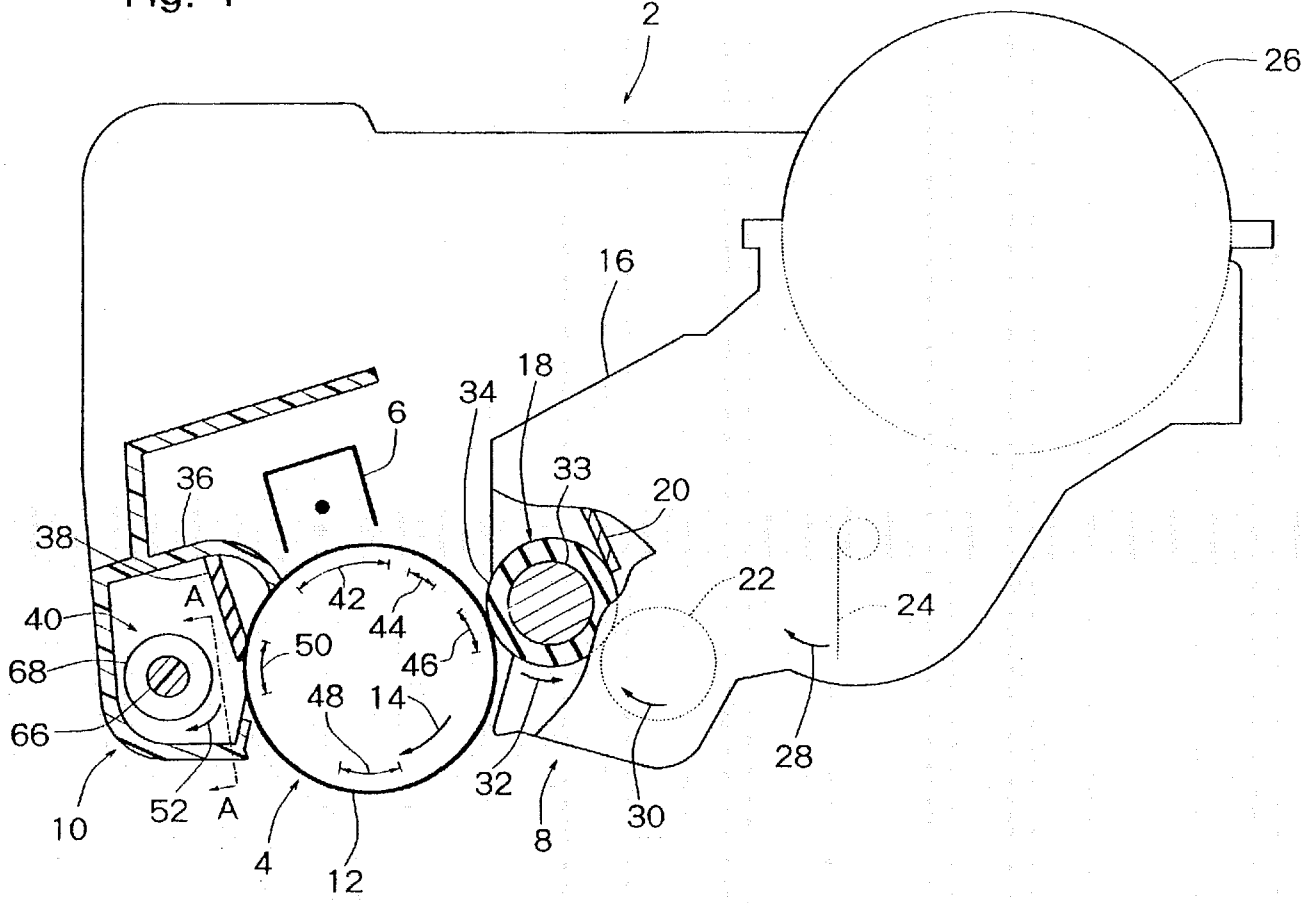
FIG. 1 is a sectional view schematically illustrating an imaging unit which includes a cleaning means which is provided with a toner conveyer constituted according to the present invention.

FIG. 1 is a sectional view illustrating an imaging unit which includes a cleaning means equipped with a toner conveyer constituted according to a preferred embodiment of the present invention. The imaging unit is equipped with a frame means which is generally designated at 2. The frame means 2 can be made of a suitable synthetic resin. The frame means 2 is provided with an image-carrying means 4, a charging means 6, a developing means 8 and the cleaning means 10. The image-carrying means 4 is constituted by a rotary drum 12 having an electrostatic photosensitive material arranged on the peripheral surface thereof. The rotary drum 12 is rotated in a direction indicated by an arrow 14. The charging means 6 is constituted by a corona discharger for charging the peripheral surface of the rotary drum 12 into a predetermined polarity.

The developing means 8 is equipped with a developing housing 16 which is furnished with a developing roller 18, a developing agent limiting member 20, a developing agent replenishing roller 22, a developing agent conveying member 24 and a toner cartridge 26. The developing agent used in the developing means 8 may be a so-called one-component developing agent comprising only the toner sent from the toner cartridge 26. The developing agent is conveyed to the developing agent replenishing roller 22 by the action of the developing agent conveying member 24 that is rotated in a direction indicated by an arrow 28, and the developing agent replenishing roller 22 that is rotated in a direction indicated by an arrow 30 feeds the developing agent onto the developing roller 18. The developing agent held on the developing roller 18 that is rotated in a direction indicated by an arrow 32 is limited for its thickness of layer to a predetermined value by the developing agent limiting member 20. The developing roller 18 can be constituted by a metallic shaft member 33 and a roller member 34 made of a synthetic rubber disposed on the peripheral surface of the shaft member 33. The developing housing 16 is mounted so as to move in a direction to approach the rotary drum 12 and in a direction to separate away therefrom, and is resiliently urged by a suitable resilient means (not shown) toward the direction to approach the rotary drum 12. Therefore, the developing roller 18 is resiliently pressed against the rotary drum 12. The toner cartridge 26 is detachably mounted on the developing agent housing 16 and is replaced by a new toner cartridge 26 after the toner in the toner cartridge 26 has been consumed.

With further reference to FIG. 1, the cleaning means 10 includes a cleaning housing 36 in which there are arranged a cleaning blade 38 and a toner conveyer 40 which is constituted according to the present invention. The cleaning blade 38 is made of a soft material such as synthetic rubber and its end is present against the peripheral surface of the rotary drum 12.

The above-mentioned imaging unit is detachably mounted on a predetermined position of a machine housing (not shown) of the image-forming machine which may be, for example, an electrostatic copying machine. The rotary drum 12 is rotated in a direction indicated by an arrow 14, the peripheral surface of the rotary drum 12 is uniformly charged to a predetermined polarity in a charging zone 42, the peripheral surface of the rotary drum 12 is irradiated in an exposing zone 44 with a suitable optical system (not shown) correspondingly to an image that is to be formed to thereby form an electrostatic latent image on the peripheral surface of the rotary drum 12. Next, in a developing zone 46, the electrostatic latent image on the peripheral surface of the rotary drum 12 is developed into a toner image by the action of the developing roller 18 in the developing means 8. In a transfer zone 48, a transfer member (not shown) which may be a common paper is brought into intimate contact with the peripheral surface of the rotary drum 12, and the toner image formed on the peripheral surface of the rotary drum 12 is transferred onto the transfer member. The transfer member onto which the toner image is transferred is peeled off the peripheral surface of the rotary drum 12, conveyed to a fixing means (not shown) where the toner image is fixed by the action of the fixing means, and is discharged out of the machine housing. In a cleaning zone 50, the residual toner remaining on the peripheral surface of the rotary drum 12 after the image transfer is removed from the peripheral surface of the rotary drum 12 by the action of the cleaning blade 38. The toner removed from the peripheral surface of the rotary drum 12 flows toward the toner conveyer 40, and is conveyed rearward by the action of the toner conveyer 40 that is rotated in a direction indicated by an arrow 52.

Here, the constitution may be the one that has been well known among people skilled in the art except the toner conveyer 40 in the cleaning means 10 in the imaging unit. Therefore, such constitution is not described in detail in this specification.

Figure 2:
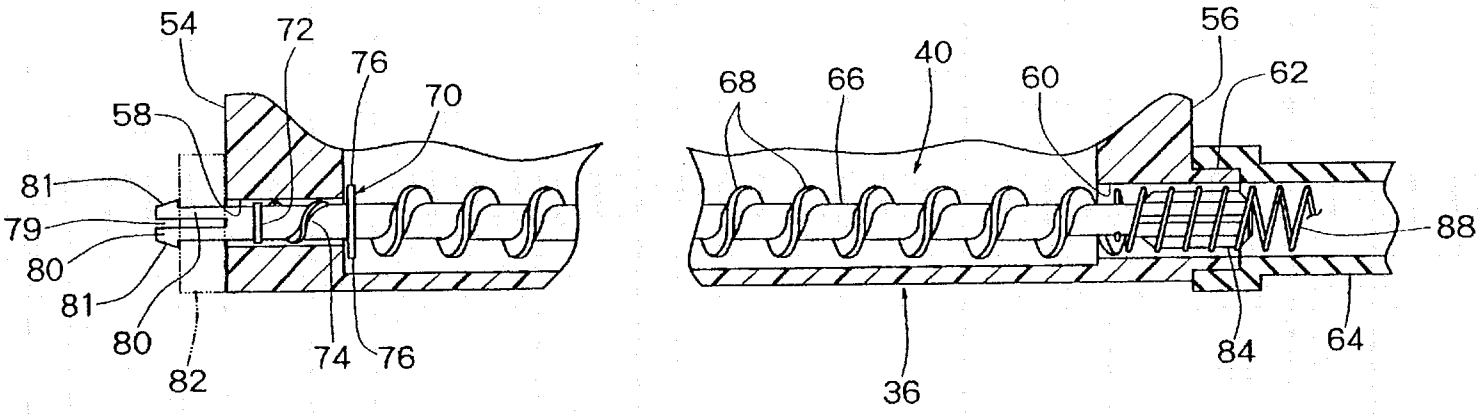
FIG. 2 is a partial sectional view along the line A—A of FIG. 1, and illustrates part of a cleaning means in the imaging unit of FIG. 1.

With reference to FIG. 2 together with FIG. 1, the cleaning housing 36 of the cleaning means 10 has a pair of side walls 54 and 56 arranged at a distance in the back-and-forth direction (in a direction perpendicular to the surface of the paper in FIG. 1, and in the right-and-left directions in FIG. 2). A through hole 58 is formed in the side wall 54 and a through hole 60 is formed in the side wall 56. Both the through hole 58 and the through hole 60 have a circular shape in lateral cross section. As will be understood with reference to FIG. 2, the center axis of the through hole 58 is in agreement with the center axis of the through hole 60. On the outer surface of the side wall 56 is formed a cylindrical protrusion 62 protruding from the peripheral edge of the through hole 60, and a base portion of a toner conveying pipe member 64 (FIG. 2 illustrates only part of it) is fitted to the protrusion 62.

Figure 3:
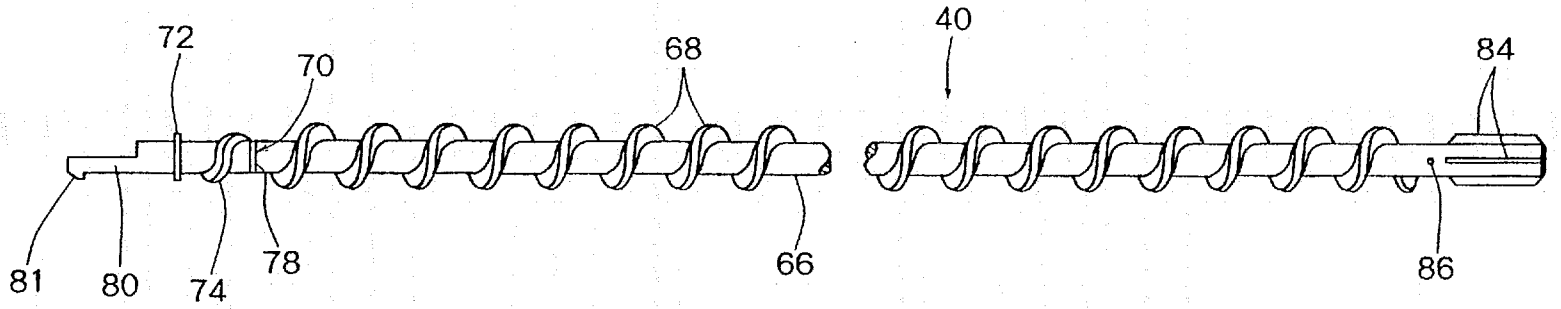
FIG. 3 is a plan view of the toner conveyer which is disposed in the cleaning means of FIG. 2.

With reference to FIGS. 2 and 3, the toner conveyer 40 arranged in the cleaning means 10 has a shaft 66 that extends straight. The shaft 66 has a circular shape in lateral cross section except the extended end portion thereof that will be described later. The one end portion, i.e., the front end of the shaft 66 (left end in FIGS. 2 and 3) is inserted in the through hole 58 formed in the side wall 54, and the other end, i.e., the rear end of the shaft 66 (right end in FIGS. 2 and 3) is inserted in the through hole 60 formed in the side wall 56, whereby the shaft 66 is mounted, being allowed to rotate, between the side walls 54 and 56. When the shaft 66 is mounted between the side walls 54 and 56, one end portion is inserted in the through hole 58 and the other end portion is inserted in the through hole 60 by resiliently bending it.

A main spiral vane 68 is formed on the outer peripheral surface of the main portion (portion except both end portions) of the shaft 66. The main spiral vane 68 extends continuously nearly over the whole width of the cleaning housing 36. In further detail, as will be comprehended from FIG. 2, the main spiral vane 68 extends from a portion close to the inner surface of the side wall 54 through up to a portion in the through hole 60 formed in the side wall 56.

An inside limiting piece 70, a sealing piece 72 and an auxiliary spiral vane 74 are formed at one end portion, i.e., at the front end of the shaft 66. The sealing piece 72 is disposed on the outer side of the inside limiting piece 70 at a predetermined distance, and the auxiliary spiral vane 74 is disposed between the sealing piece 72 and the inside limiting piece 70. As will be clearly understood with reference to FIGS. 2 and 3 together with FIG. 4, the inside limiting piece 70 is nearly of a rectangular shape which extends slenderly, and has two protruded portions 76 positioned opposed to each other in the direction of diameter and two non-protruded portions 78 existing between the protruded portions 76. The protruded portions 76 of the inside limiting piece 70 protrudes in the radial direction exceeding the inner diameter of the through hole 58 formed in the side wall 54. That is, the protruded portions 76 of the inside limiting piece 70 come into contact with the inner surface of the side wall 54, and limit the shaft 66 from moving toward the side wall 54, i.e., limit the shaft 66 from moving leftwards in FIG. 2. On the other hand, the non-protruded portions 78 of the inside limiting piece 70 are positioned on the inside of the inner diameter of the through hole 58 formed in the side wall 54 in the radial direction. Therefore, even when the inside limiting piece 70 comes into contact with the inner surface of the side wall 54, the through hole 58 is not completely closed by the inside limiting piece 70; i.e., the through hole 58 is communicated with the interior of the cleaning housing 36 through open portions designated at 77 in FIG. 4. The sealing piece 72 has a circular shape and has an outer diameter which is substantially equal to, or is slightly smaller than, the inner diameter of the through hole 58. The auxiliary spiral vane 74 disposed between the sealing piece 72 and the inside limiting piece 70 may have an outer diameter which is substantially the same as the outer diameter of the sealing piece 72. As clearly shown in FIG. 2, the sealing piece 72 and the auxiliary spiral vane 74 are positioned inside the through hole 58 formed in the side wall 54.

With further reference to FIGS. 2 and 3, the front end of the shaft 66 extends out of the cleaning housing 36 passing through the hole 58 formed in the side wall 54. As will be understood with reference to FIG. 2, the extended end portion of the shaft 66 has a D-shape instead of a circular shape in lateral cross section. A slit 79 is formed in the extended end portion of the shaft 66 extending in the axial direction from the end surface thereof and the extended end portion of the shaft 66 is split into two arms 80. At the end of each of the two arms 80 is formed an expanded head portion 81 which is outwardly swelled in the radial direction. An input member 82 which may be constituted by an input gear is mounted on the extended end portion of the shaft 66 as indicated by a two-dot chain line in FIG. 2. In the input member 82 is formed a mounting opening of a D-shape corresponding to the lateral sectional shape of the extended end portion of the shaft 66 or, in further detail, corresponding to the lateral sectional shape defined by the portions of the two arms 80 other than the expanded head portions 81. The ends of the two arms 80 are resiliently deformed in a direction in which the expanded head portions 81 approach each other, the input member 82 is fitted onto the two arms 80 and is forced to pass over the expanded head portions 81 so as to be mounted on the extended end portion of the shaft 66. After the input member 82 has passed over the expanded head portions 81, the two arms 80 are resiliently restored to the initial state, i.e., to the state shown in FIGS. 2 and 3, and the input member 82 is not allowed to escape from the extended end portion by the engaging action of the expanded head portions 81. The extended end portion of the shaft 66 and the mounting opening of the input member 82 have a D-shape in lateral cross section. Therefore, the input member 82 mounted on the extended end portion of the shaft 66 is not allowed to turn relatively with respect to the shaft 66, and the input member 82 and the shaft 66 rotate together as a unitary structure. Attention should be given to the fact that the input member 82 is easily and quickly mounted on the extended end portion of the shaft 66 using neither a stop ring nor a stop screw. As clearly shown in FIG. 2, the input member 82 mounted on the extended end portion of the shaft 66 is brought close to, or in contact with, the outer surface of the side wall 54, whereby the shaft 66 is limited from moving toward the side wall 56, i.e., limited from moving rightwards in FIG. 2.

Referring to FIGS. 2 and 3, four protruded pieces 84 are each formed at the rear end of the shaft 66 at an angular distance of 90 degrees. Each protruded piece 84 consists of a plate extending in the radial direction. In the rear end of the shaft 66 is further formed an engaging hole 86 on the inside of the protruded pieces 84 penetrating through in the direction of diameter thereof. As clearly shown in FIG. 2, the rear end of the shaft 66 is inserted in the through hole 60 formed in the side wall 56. A coil spring 88 is disposed in the above-mentioned toner conveying pipe member 64, and one end of the coil spring 88 is coupled to the rear end of the shaft 66. In further detail, one end of the coil spring 88 is wound on the protruded pieces 84 formed on the rear end of the shaft 66 and is inserted in the engaging hole 86. Therefore, when the toner conveyer 40 is rotated in the direction indicated by the arrow 52 (FIG. 1), the coil spring 88 rotates together.

It is desired that the shaft 66, main spiral vane 68, inside limiting piece 70, sealing piece 72, auxiliary spiral vane 74 and protruded pieces 84 in the toner conveyer 40 are formed of a suitable synthetic resin as a unitary structure.

With further reference to FIG. 2, the input member 82 mounted on the extended end portion of the shaft 66 is coupled to an electric motor (not shown) via a suitable transmission element (not shown). When the electric motor is energized, the toner conveyer 40 is rotated in the direction indicated by the arrow 52 (FIG. 1). Then, the toner removed from the peripheral surface of the rotary drum 12 and contained in the cleaning housing 36, is conveyed rearwardly, i.e., rightwardly in FIG. 2, by the action of the main spiral vane 68, and is sent into the toner conveying pipe member 64 through the hole 60 formed in the side wall 56. The toner sent into the toner conveying pipe member 64 is conveyed through the toner conveying pipe member 64 by the action of the coil spring 88 that is rotated with the rotation of the toner conveyer 40, and is sent into a toner-recovering container (not shown) through a toner discharge port (not shown) formed in the front end of the toner conveying pipe member 64.

Figure 4:
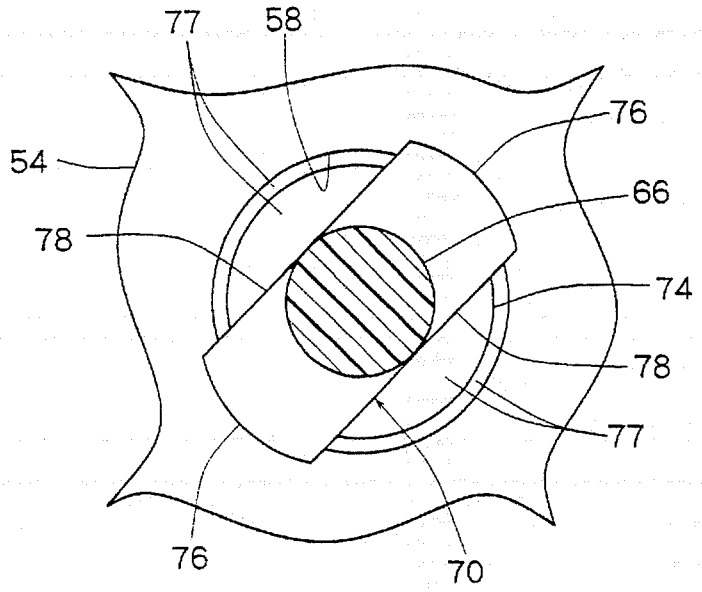
FIG. 4 is a partial sectional view illustrating an inside limiting piece formed in the toner conveyer of FIG. 3.

The toner contained in the cleaning housing 36 is conveyed rearwardly, i.e., rightwardly in FIG. 2 by the action of the main spiral vane 68 of the toner conveyer 40, as described above. Here, the inside limiting piece 70 formed at the front end of the shaft 66 has non-protruded portions 78, and the through hole 58 formed in the side wall 54 is communicated with the interior of the cleaning housing 36 via the open portions 77 (FIG. 4 ). Therefore, the toner contained in the cleaning housing 36 may happen to move leftwards in FIG. 2 to enter into the through hole 58. However, the toner that has entered into the through hole 58 is conveyed rightwardly in FIG. 2 by the conveying action of the auxiliary spiral vane 74 and is returned back into the cleaning housing 36. Therefore, the toner does not deposit in the through hole 58 and does not impair smooth rotation of the toner conveyer 40. Besides, the toner is very reliably prevented from leaking out of the cleaning housing 36 passing through the hole 58 by the returning action of the auxiliary spiral vane 74 and the closing action of the sealing piece 72.

In the foregoing was described in detail a preferred embodiment of the toner conveyer constituted according to the present invention with reference to the accompanying drawings. It should, however, be noted that the invention is in no way limited to the above-mentioned embodiment only but can be changed or modified in a variety of ways without departing from the scope of the invention.

What we claim is:

1. A toner conveyer for a housing having a pair of side walls, at least one of side walls having a hole defined therethrough, comprising:

a shaft having an end portion received in said hole, said shaft being rotatably mounted between said side walls;

a main spiral vane disposed on the outer peripheral surface of a main portion of said shaft;

an inside limiting piece disposed on said shaft, said inside limiting piece having at least one protruded portion and at least one non-protruded portion, said protruded portion extending in the radial direction beyond the inner diameter of said hole, said non-protruded portion extending in the radial direction less than the inner diameter of said hole, and said shaft being limited from moving toward said side wall having said hole defined therethrough by said protruded portion contacting the inner surface thereof, said hole being in communication with the interior of said housing via an opening defined in part by said non-protruded portion; and an auxiliary spiral vane formed on said end portion of said shaft received in said through hole, said auxiliary spinal vane moving toner in said hole to the housing via said opening defined in part by said non-protruded portion of said inside limiting piece when said shaft is rotated in a predetermined direction.

2. The toner conveyer according to claim 1, wherein said toner conveyer further includes a sealing piece disposed on said end portion of said shaft, said sealing piece having an outer diameter which is substantially the same as, or is slightly smaller than, the inner diameter of said hole.

3. The toner conveyer according to claim 2, wherein said shaft, said main spiral vane, said inside limiting piece, said auxiliary spiral vane and said sealing piece are formed of a synthetic resin as a unitary structure.

4. The toner conveyer according to claim 1, wherein an extended end portion of said shaft extends out of said housing through said hole, an input member is mounted on said extended end portion, said input member contacting the outer surface of one of said side walls and limits said shaft from moving toward the other one of said side walls thereby.

5. The toner conveyer according to claim 4, wherein said extended end portion of said shaft is split to define two arms and a slit, said slit extending in the axial direction from the end surface, each of said two arms including expanded head portions disposed at ends thereof, said input member having a mounting opening defined therein, said mounting opening having a lateral cross-sectional shape corresponding to a lateral cross-sectional shape defined by the portions of said two arms other than said expanded head portions, said input member being mounted on said extended end portion of said shaft by said expanded head portions being received in said mounting opening by said two arms elastically deforming such that said expanded head portions are brought close to each other.

6. The toner conveyer according to claim 1, wherein a toner discharge port is defined through one of said pair of said walls other than said side wall in which said hole is defined, the other end portion of said shaft being received in the toner discharge port.

7. The toner conveyer according to claim 6, wherein said main spiral vane conveys toner in said housing toward said toner discharge port.

8. The toner conveyer according to claim 1, wherein:

said at least one protruding portion comprises two protruding portions; and said at least one non-protruding portion comprises two non-protruding portions.

* * * * *